US005489884A

United States Patent [19]

Heringer et al.

[11] Patent Number: 5,489,884

[45] Date of Patent: Feb. 6, 1996

[54] INDUCTIVE ELECTRIC COMPONENT

[75] Inventors: Egon Heringer, Huglfing; Horst Scheffler, München, both of Germany

[73] Assignee: Siemens Atiengesellschaft, Munich, Germany

[21] Appl. No.: 427,162

[22] Filed: Apr. 28, 1995

Related U.S. Application Data

[63] Continuation of Ser. No. 141,275, Oct. 22, 1993, abandoned.

[30] Foreign Application Priority Data

Oct. 22, 1992 [DE] Germany ..... 42 35 703.9

[51] Int. Cl.[6] ..... H01F 27/26; H01F 27/30

[52] U.S. Cl. ..... 336/210; 336/65; 336/83

[58] Field of Search ..... 336/65, 67, 83, 336/210, 197; 310/217

[56] References Cited

U.S. PATENT DOCUMENTS

| | | | |
|---|---|---|---|
| 3,197,167 | 7/1965 | Sturgis | 336/83 |
| 3,371,301 | 2/1968 | Hisano | 336/83 |
| 4,549,158 | 10/1985 | Mitsui et al. | 336/210 |

FOREIGN PATENT DOCUMENTS

| | | |
|---|---|---|
| 0026104 | 4/1981 | European Pat. Off. . |
| 0104649 | 4/1984 | European Pat. Off. . |
| 3629006 | 3/1988 | Germany . |

OTHER PUBLICATIONS

Siemens Data Book 1990/91, "Ferrite und Zubehoer" pp. 321–323, 338 and 339.

Siemens Aktiengesellschaft Databook 1990/91, ferrites and accessories.

*Primary Examiner*—Thomas J. Kozma

*Attorney, Agent, or Firm*—Herbert L. Lerner; Laurence A. Greenberg

[57] ABSTRACT

An inductive electric component, in particular an electric transformer, includes a coil body having coil body flanges defining a winding space, and contact pin strips integrally formed onto the coil body flanges, the contact pin strips having extensions and having free ends with undercuts formed therein being limited outwardly by the extensions. A two-part magnet core has halves with center bosses to be pushed together on the coil body with the center bosses engaging the coil body and resting on the coil body flanges and on the contact pin strips. A spring cap is to be slipped onto the magnet core disposed on the coil body for retaining the magnet core halves on the coil body. The cap has a yoke with a middle region. The yoke is concave at least in the middle region, and the yoke has legs on two opposite sides and spring hoops on two other opposite sides. The legs each have detent protrusions locking into the undercuts with the spring cap slipped on. With the spring cap slipped on, the concave region engages an outer surface of the magnet core facing away from the contact pin strips, the legs rest on two opposite outer surfaces of the magnet core being perpendicular to the contact pin strips, and the spring hoops engage two other opposite outer surfaces of the magnet core.

5 Claims, 1 Drawing Sheet

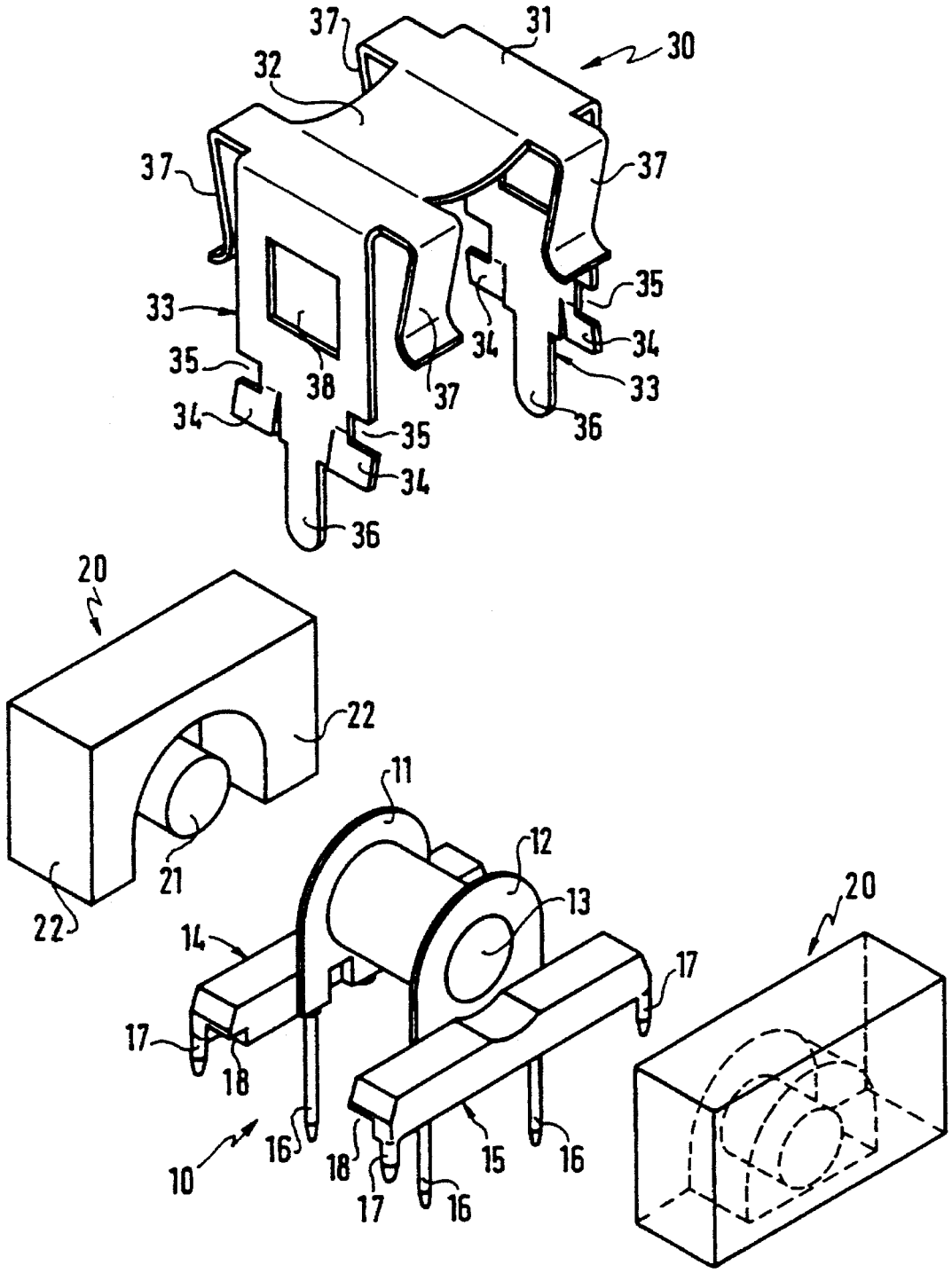
37
31
30
32
37
37
35
33
34
34
35
38
37
33
34
35
36
34
36
20
22
11
12
21
13
20
22
14
17
17
18
16
10
18
15
16
17
16

INDUCTIVE ELECTRIC COMPONENT

This application is a continuation of application Ser. No. 08/141,275, filed Oct. 22, 1993, now abandoned.

BACKGROUND OF THE INVENTION

Field of the Invention

The present invention relates to an inductive electric component, in particular an electric transformer, including a coil body which has contact pin strips integrally formed onto coil body flanges that define a winding space; a two-part magnet core having halves which can be pushed together on the coil body in such a way that they engage the coil body with center bosses and rest both on the coil body flanges and the contact pin strips; and a spring cap which can be slipped onto the magnet core located on the coil body for retaining the magnet core halves on the coil body, the cap having a yoke being concave at least in its middle region, legs on two opposite sides and spring hoops on two other opposite sides; wherein with the spring cap slipped on, the concave region engages the outside of the magnet core facing away from the contact pin strips, the legs rest on two opposite sides on outsides of the magnet core that are perpendicular to the contact pin strips, and the spring hoops engage two further opposite sides of the magnet core.

Such inductive components are known, for instance, from Siemens Data Book 1990/91, "Ferrite und Zubehör" [Ferrites and Accessories], particularly pp. 321–323 as well as 338 and 339.

One embodiment of a typical transformer model has a coil body and a so-called EP ferrite core, in the form of two core halves that can be mounted on the coil body. A further explanation thereof can be gathered from the description of the drawing, for the sake of simplicity. In such a device, a coil body has a winding space defined by two coil body flanges with a cylindrical through hole for receiving center bosses of EP core halves. The coil body also has two integrally formed-on contact pin strips with contact pins.

Two EP core halves with center bosses and core legs can be slipped onto the coil body in such a way that the center bosses engage the cylindrical through hole and the core legs are seated on the contact pin strips.

To that extent, the transformer model in question is generally known, and reference may be made, for instance, to the view shown on page 323 of the aforementioned Siemens Data Book.

In the known transformer model with an EP core, the core halves are held on the coil body by means of a retainer device that is formed by two separate parts, namely a hoop and a clamp. Both the hoop and the clamp are U-shaped in principle. The hoop has one detent protrusion on the outside of each of the two legs of the U-shaped element, while the clamp has one recess adapted to each of the detent protrusions of the hoop, on each of the legs of the U-shaped element.

The hoop and the clamp are each slipped from one side in the direction of the central axis of the through hole in the coil body and the center boss of the core halves onto the assembled unit including the coil body and the core halves, in the course of which the detent protrusions of the hoop then lock into place in the recesses in the clamps. Since the yoke of the clamp is constructed in such a way as to be concave and thus exerts an additional spring action, the core halves are pushed together in the direction of the aforementioned axis on the coil body and held. Moreover, the hoop seated on one core half has two legs being oriented inwardly and engaging the core half. They assure a certain retention at right angles to the aforementioned axis (which is also the magnetic axis of the transformer).

An embodiment of the type explained above is not completely satisfactory in terms of the retention of the core halves on the coil body. However, although the hoop and the clamp assure good retention in the direction of the magnetic axis, they do not always assure adequate retention at right angles to that axis, so that the core halves may still have a certain amount of play on the coil body, which can have a negative effect on the electromagnetic properties of the transformer.

Another known version of a typical transformer model has a so-called Q core, in the form of two core halves. With respect to the coil body and the ferrite core, this model generally matches the model with the EP core described above. In order to retain the two core halves on the coil body, a covering tab is provided, which is slipped from above onto this unit including the coil body and the core, with the core halves placed on the coil body. In the direction of the magnetic axis, the covering cap has two resilient legs on each of the opposite sides, and those legs engage the outsides of the core halves and press them together on the coil body in the direction of the magnetic axis. The problem addressed above of possibly inadequately fastening the core halves at right angles to the magnetic axis on the coil body still exists in that case.

SUMMARY OF THE INVENTION

It is accordingly an object of the invention to provide an inductive electric component, which overcomes the hereinafore-mentioned disadvantages of the heretofore-known devices of this general type and which has a capability of adequately fastening a magnetic core on a coil body both in a magnetic axis and at right angles thereto.

With the foregoing and other objects in view there is provided, in accordance with the invention, an inductive electric component, in particular an electric transformer, comprising a coil body having coil body flanges defining a winding space, and contact pin strips integrally formed onto the coil body flanges, the contact pin strips having extensions and having free ends with undercuts formed therein being limited outwardly by the extensions; a two-part magnet core having opposite outer surfaces, an outer surface facing away from the contact pin strips, and halves with center bosses to be pushed together on the coil body with the center bosses engaging the coil body and resting on the coil body flanges and on the contact pin strips; and a spring cap to be slipped onto the magnet core disposed on the coil body for retaining the magnet core halves on the coil body, the cap having a yoke with a middle region and opposite sides, the yoke being concave at least in the middle region, and the yoke having legs on two of the opposite sides and spring hoops on two others of the opposite sides, the legs each having detent protrusions locking into the undercuts with the spring cap slipped on; and with the spring cap slipped on, the concave region engaging the outer surface of the magnet core facing away from the contact pin strips, the legs resting on two of the opposite outer surfaces of the magnet core being perpendicular to the contact pin strips, and the spring hoops engaging two others of the opposite outer surfaces of the magnet core.

In accordance with another feature of the invention, the legs have free ends, the legs have notches formed therein in the vicinity of the free ends forming the detent protrusions, and the notches have dimensions corresponding to dimensions of the contact pin strips.

In accordance with a further feature of the invention, the legs have a surface, and the detent protrusions are inclined outwardly from the surface of the legs.

In accordance with a concomitant feature of the invention, the legs have recesses formed therein.

Other features which are considered as characteristic for the invention are set forth in the appended claims.

Although the invention is illustrated and described herein as embodied in an inductive electric component, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is an exploded view of an inductive electric component according to the invention.

DESCRIPTION OF THE PREFERRED EMBODIMENTS

Referring now to the single FIGURE of the drawing in detail, there is seen a coil body 10 which has a winding space defined by two coil body flanges 11, 12, with a cylindrical through hole 13 for receiving center bosses 21 of EP core halves 20 to be described below. The coil body 10 also has two integrally formed-on contact pin strips 14, 15 with contact pins 16.

The two EP core halves 20 with the center bosses 21 and core legs 22 can be slipped onto the coil body 10 in such a way that the center bosses 21 engage the cylindrical through hole 13, and the core legs 22 are seated on the contact pin strips 14, 15.

An exemplary embodiment of the invention includes the coil body 10 and the magnet core with the two magnet core halves 20 discussed above. In order to fasten the magnet core halves 20 to the coil body 10, a spring cap 30 which is constructed in accordance with the invention is provided in combination with a special embodiment of the contact pin strips 14, 15 of the coil body 10, that is adapted to it.

The spring cap 30 has a yoke 31, which at least in its middle region 32 is concavely constructed and as a result is provided with an additional spring action. Legs 33 are provided on two opposite sides of this yoke 31 and have detent protrusions 34 which are preferably inclined outwardly from the surface of the legs 33. These detent protrusions 34 are formed by providing the region of the free ends of the legs 33 with notches 35 having dimensions that match those of the contact pin strips 14, 15 of the coil body 10. The side of the legs 33 opposite from the detent protrusions 34 continue in the form of grounding pins 36.

Spring hoops 37 are provided on the yoke 31 in a plane at right angles to the legs 33 of the spring cap 30.

As an adaptation to the detent protrusions 34 of the spring cap 30, the coil body 10 has undercuts 18 on free ends of the contact pin strips 14, 15. The undercuts 18 are limited on the outside by extensions 17.

Once the magnet core halves 20 have been slipped onto the coil body 10, in such a way that the center bosses 21 engage the cylindrical through hole 13 and the outer legs 22 are seated on the contact pin strips 14, 15, if the spring cap 30 is then slipped from above onto the unit including the coil body 10 and the magnet core 20, 21, 22, then the detent protrusions 34 engage the undercuts 18. As a result, the core halves 20 are retained on the coil body 10 in the direction at right angles to the magnetic axis, that is the central axis extending through the through hole 13 and the center bosses 21. In the direction of the magnetic axis, the core halves 20 are held together by the spring hoops 37. In this way, the core halves 20 are held firmly on the coil body 10 in two directions at right angles to one another, so that it is no longer possible for impairments to the electromagnetic properties of the inductive component to arise.

In order to further improve stability, recesses 38 are provided in the legs 33 of the spring cap 30, by way of which the spring cap 30 can be adhesively connected to the core halves 20.

We claim:

1. An inductive electric component, comprising:

a coil body having coil body flanges defining a winding space, and contact pin strips integrally formed onto said coil body flanges, said contact pin strips having extensions and having free ends with undercuts formed therein being limited outwardly by said extensions;

a two-part magnet core having opposite outer surfaces, an outer surface facing away from said contact pin strips, and halves with center bosses to be pushed together on said coil body with said center bosses engaging said coil body and resting on said coil body flanges and on said contact pin strips; and a spring cap to be slipped onto said magnet core disposed on said coil body for retaining said magnet core halves on said coil body, said cap having a yoke with a middle region and opposite sides, said yoke being concave at least in said middle region, and said yoke having legs on two of said opposite sides and spring hoops on two others of said opposite sides, said legs each having detent protrusions locking into said undercuts with said spring cap slipped on; and with said spring cap slipped on, said concave region engaging said outer surface of said magnet core facing away from said contact pin strips, said legs resting on two of said opposite outer surfaces of said magnet core being perpendicular to said contact pin strips, and said spring hoops engaging two others of said opposite outer surfaces of said magnet core.

2. The component according to claim 1, wherein said legs have free ends, said legs have notches formed therein in the vicinity of said free ends forming said detent protrusions, and said notches have dimensions corresponding to dimensions of said contact pin strips.

3. The component according to claims 1, wherein said legs have a surface, and said detent protrusions are inclined outwardly from said surface of said legs.

4. The component according to claims 2, wherein said legs have a surface, and said detent protrusions are inclined outwardly from said surface of said legs.

5. The component according to claim 1, wherein said legs have recesses formed therein.

* * * * *

UNITED STATES PATENT AND TRADEMARK OFFICE

CERTIFICATE OF CORRECTION

PATENT NO. : 5,489,884

DATED : February 6, 1996

INVENTOR(S) : Egon Heringer, Horst Scheffler

It is certified that error appears in the above-indentified patent and that said Letters Patent is hereby corrected as shown below:

On title page, Item (73)

change "Assignee: Siemens Atiengesellschaft, Munich, Germany"

to

-- Assignee: Siemens Matsushita Components GmbH & Co. KG. Munich, Germany --

Signed and Sealed this

Thirty-first Day of December, 1996

*Attest:*

Bruce Lehman

BRUCE LEHMAN

*Attesting Officer*

*Commissioner of Patents and Trademarks*